US008113873B1

(12) United States Patent
Sarraf

(10) Patent No.: US 8,113,873 B1
(45) Date of Patent: Feb. 14, 2012

(54) PIVOT ASSISTED STORAGE DEVICE UNLOADING MECHANISM

(75) Inventor: Mohammad Sarraf, Trabuco Canyon, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 75 days.

(21) Appl. No.: 12/564,824

(22) Filed: Sep. 22, 2009

(51) Int. Cl.
*H01R 13/40* (2006.01)

(52) U.S. Cl. ..... 439/533

(58) Field of Classification Search ..... 439/533–535, 439/929, 164, 248
See application file for complete search history.

(56) References Cited

U.S. PATENT DOCUMENTS

| | | | | |
|---|---|---|---|---|
| 6,193,546 | B1 * | 2/2001 | Sadler | 439/534 |
| 7,014,486 | B1 * | 3/2006 | Wu et al. | 439/248 |
| 7,167,372 | B2 | 1/2007 | Mori et al. | |
| 7,253,840 | B2 | 8/2007 | Kayanuma | |
| 7,333,328 | B2 | 2/2008 | Funawatari et al. | |
| 7,414,668 | B2 | 8/2008 | Takahashi | |
| 2004/0097127 | A1 * | 5/2004 | Smith et al. | 439/533 |
| 2004/0141253 | A1 | 7/2004 | Funawatari et al. | |
| 2008/0142651 | A1 | 6/2008 | Tomasini et al. | |
| 2008/0304240 | A1 | 12/2008 | Shigemori | |

* cited by examiner

*Primary Examiner* — Alexander Gilman

(57) ABSTRACT

A storage device cradle includes a housing having a receiving surface sized and configured to receive at least a portion of a storage device, the receiving surface having a hole defined therethrough. An external interface of the cradle is configured to communicatively couple to a computer, and a storage device connector extends at least partially through the hole in the receiving surface. The storage device connector is communicatively coupled to the external interface, configured to couple to the storage device, and rotatable about a pivot axis defined by at least one shaft mounted within the housing.

20 Claims, 9 Drawing Sheets

PIVOT ASSISTED STORAGE DEVICE UNLOADING MECHANISM

BACKGROUND

External storage devices may be communicatively coupled to a computer in a variety of ways. For some storage devices, a cable may be coupled directly between the storage device's housing and the computer. For other storage devices, a wireless connection (e.g., a Bluetooth connection) may be created between circuitry in both the storage device and the computer. For still other storage devices, a separate cradle is first coupled to the computer (e.g., via a USB cable), and the storage device may then mate with the cradle by any of a variety of connectors. The cradle solution may enable a user to more conveniently connect and disconnect a storage device from a computer and has been a preferred solution for many storage devices.

One challenge in designing storage device cradles is finding the proper balance between a tight fit for the mating connectors of the storage device and the cradle, in order to ensure proper electrical interconnection, and providing sufficient space/mechanical give between the mating connectors, in order to allow the storage device to disconnect from the cradle without undue effort. If the fit is too tight, the storage device must be wrenched off of the cradle, and the delicate mating connectors may be damaged. If the fit is too loose, electrical shorts may arise between the storage device and the cradle.

There is therefore a need for an improved cradle for coupling between a storage device and a computer.

DETAILED DESCRIPTION

Figure 1:
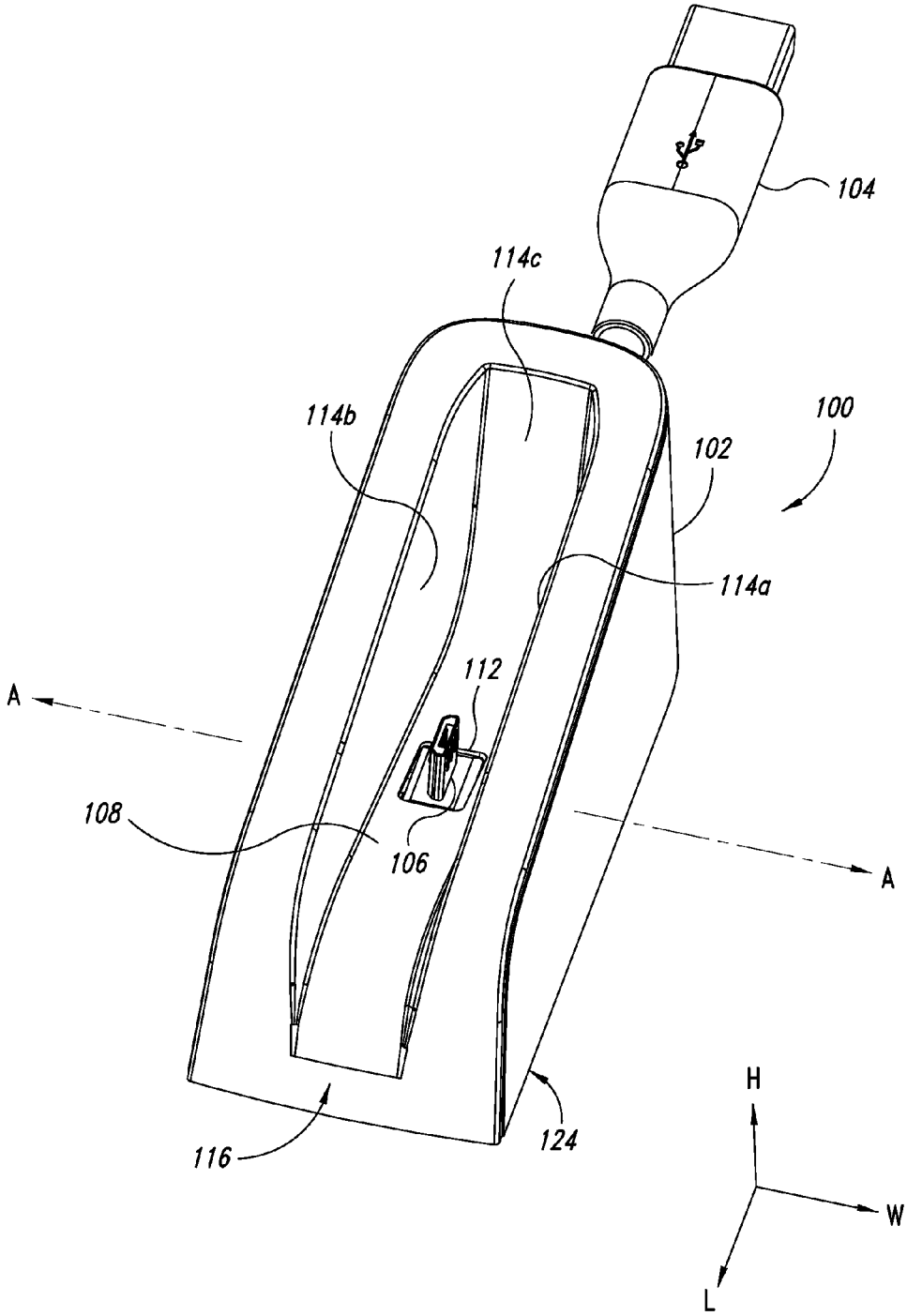
FIG. 1 is a perspective view of a storage device cradle, according to one illustrated embodiment.
Figure 2:
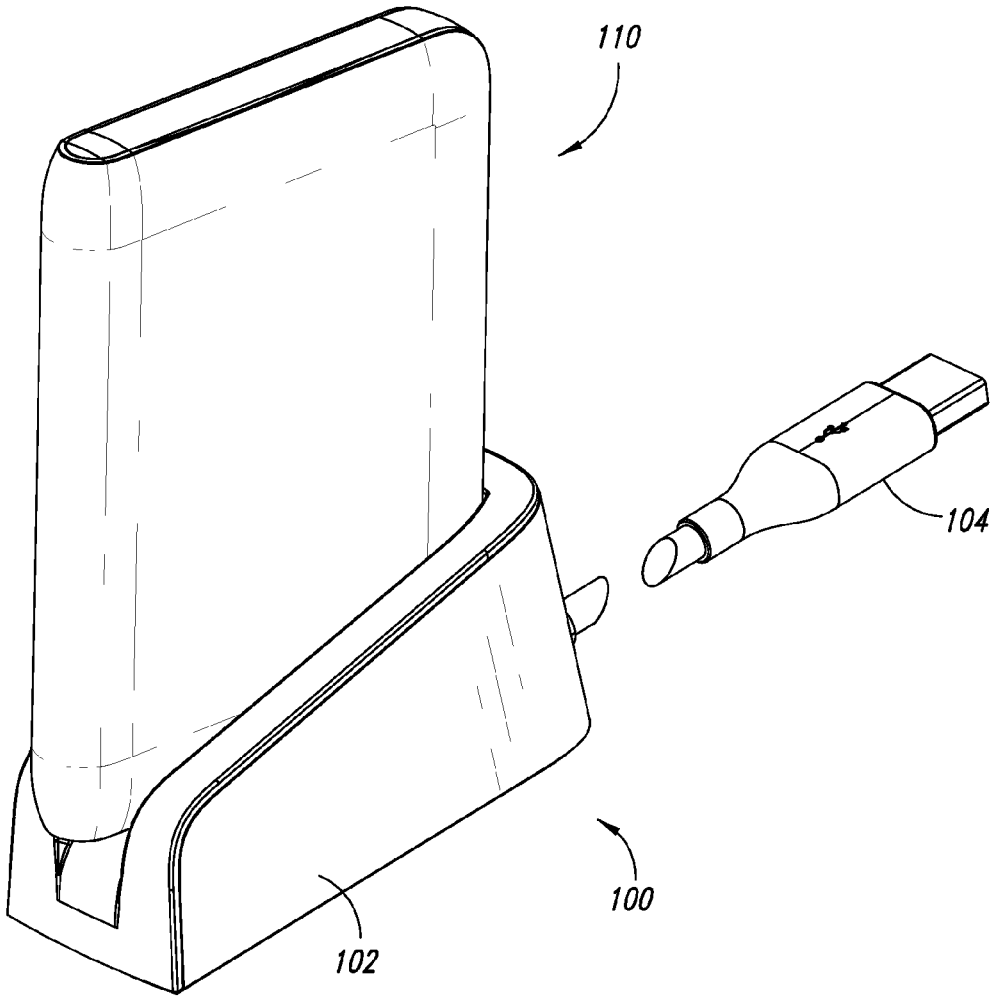
FIG. 2 is a perspective view of the storage device cradle of FIG. 1 holding a storage device, according to one illustrated embodiment.

Referring to FIGS. 1 and 2, a storage device cradle 100 is illustrated, according to one embodiment. The storage device cradle 100 comprises a housing 102, an external interface 104 and a storage device connector 106. The housing 102 includes a receiving surface 108 sized and configured to receive at least a portion of a storage device 110 (shown in FIG. 2), the receiving surface 108 having a hole 112 defined therethrough. The external interface 104 is configured to communicatively couple to a computer (not shown). The storage device connector 106 extends at least partially through the hole 112 in the receiving surface 108, the storage device connector 106 communicatively coupled to the external interface 104 and configured to couple to the storage device 110. In one embodiment, the storage device connector 106 is rotatable about a pivot axis A defined by at least one shaft (not shown in FIGS. 1 and 2) mounted within the housing 102.

The storage device cradle 100 may comprise any of a variety of cradles configured to receive a storage device 110 and to enable communications between the storage device 110 and a computer. In one embodiment, the storage device cradle 100 is designed specifically for a particular type of storage device 110. In other embodiments, the storage device cradle 100 may be a more universal cradle designed to accommodate storage devices of different types, sizes and configurations. The storage device cradle 100 may also be designed to receive more than one storage device 110 at a time. In one embodiment, the storage device cradle 100 may comprise a distinct component; however, in other embodiments, the storage device cradle 100 may comprise one part of a system having multiple components.

The housing 102 of the storage device cradle 100 includes a receiving surface 108 sized and configured to receive at least a portion of the storage device 110. In one embodiment, as illustrated in FIG. 2, the receiving surface 108 may partially support the storage device 110 along one sidewall of the storage device 110 placed against the housing 102. In other embodiments, one or more surfaces of the storage device 110 may be received by the receiving surface 108, depending upon the configuration of both the storage device 110 and the housing 102. In some embodiments, the receiving surface 108 may be configured to contact the storage device 110 only during loading and/or unloading operations.

The receiving surface 108 may be formed between three walls 114*a-c* of the housing 102. As illustrated in FIG. 2, these three walls 114*a-c* may help to align and then support the storage device 110, when the storage device 110 is properly positioned on the storage device cradle 100. Of course, in other embodiments, one or more of the ancillary walls 114*a-c* may be omitted, or additional walls may be added to the housing 102.

The receiving surface 108 may be substantially planar along its length, extending from the rear wall 114*c* of the storage device cradle 100 towards the front 116 of the storage device cradle 100. However, in other embodiments, the receiving surface 108 may include any of a variety of contours (abrupt or gradual), which may facilitate a mating connection with particular types of storage devices. As illustrated in FIG. 1 (as well as in additional Figures), a set of axes may be defined to facilitate discussion regarding the storage device cradle 100. A first axis L may be defined substantially parallel the length of the receiving surface 108, a second axis W may be defined substantially parallel a width of the receiving surface 108, and a third axis H may be defined perpendicular to both the L and W axes. As illustrated, the receiving surface 108 may define a length along the first axis L and may define a width substantially shorter than the length along the second axis W perpendicular to the first axis L.

In one embodiment, the receiving surface 108 further includes a hole 112 defined therethrough. The hole 112 may have any of a variety of sizes and shapes, and may be sized and configured to enable the storage device connector 106 to extend at least partially therethrough. The housing 102 may further include a bottom surface 124 configured to lie against a supporting surface, such as the ground or a table. In one embodiment, the receiving surface 108 extends along the axis L at an angle to the bottom surface 124, which may facilitate the loading and unloading of the storage device 110.

The housing 102 of the storage device cradle 100 may be formed from any of a variety of materials. In one embodiment, the housing 102 may be formed from a molded plastic. In other embodiments, heavier materials may be used to form the housing 102 in order to increase the overall mass of the storage device cradle 100. Such increased mass may facilitate the unloading of the storage device 110 by acting as a counterweight to the forces created as the connectors of the storage device 110 and the storage device cradle 100 are separated. The housing 102 may also be formed as a unitary body or may be assembled from a plurality of pieces.

The external interface 104 may comprise any of a variety of interfaces configured to communicatively couple to a computer (not shown). In one embodiment, as illustrated, the external interface 104 may comprise a wired universal serial bus (USB) connector. In another embodiment, the external interface 104 may comprise some other wired serial or parallel interface. In still other embodiments, the external interface 104 may comprise a wireless interface configured to communicate according to one or more protocols and may include one or more antennas.

The storage device connector 106 may comprise any of a variety of connectors communicatively coupled to the external interface 104 and configured to couple to the storage device 110. In some embodiments, the storage device connector 106 need not comply with the same interface standards as the external interface 104, and the storage device cradle 100 may include circuitry communicatively coupled between the storage device connector 106 and the external interface 104. However, in other embodiments, as illustrated, the storage device connector 106 may comply with the same interface standards as the external interface 104, and a cable (not visible) may extend between the storage device connector 106 and the external interface 104. For example, the storage device connector 106 may comprise a USB connector, such as a mini-USB, micro-USB or other USB-compatible connector, and a cable may extend from the storage device connector 106 to the USB-compatible external interface 104.

Figure 3:
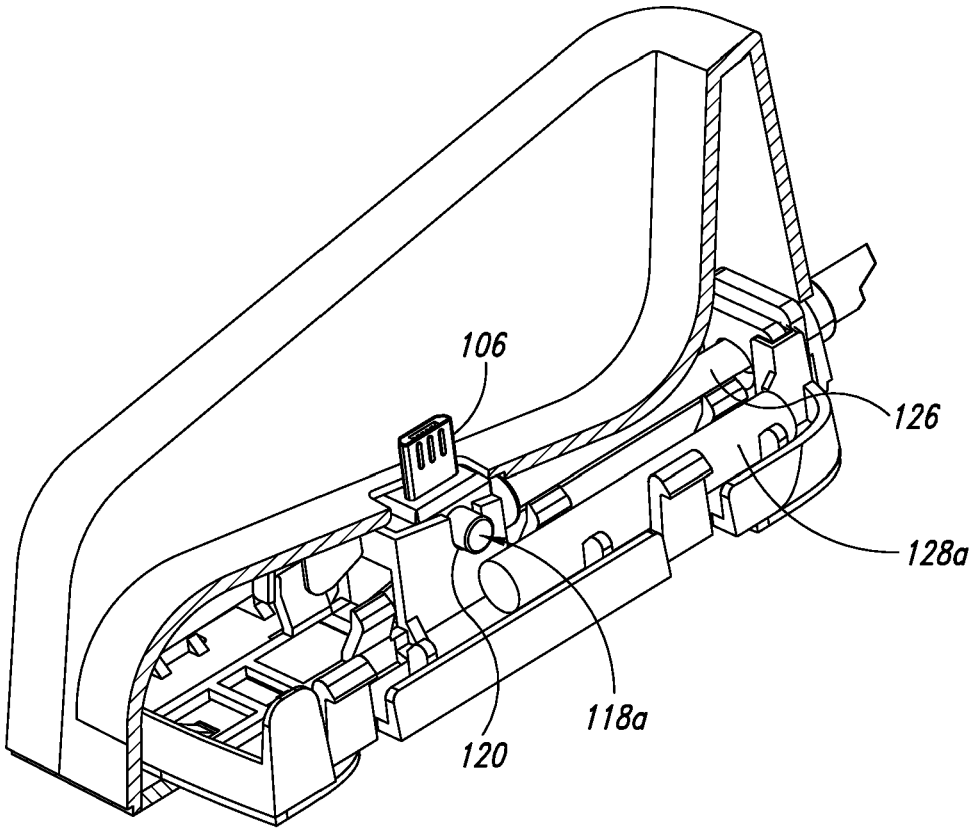
FIG. 3 is a perspective view of the storage device cradle of FIG. 1 with a portion of a housing of the storage device cradle removed, according to one illustrated embodiment.

In one embodiment, the storage device connector 106 is positioned to extend at least partially through the hole 112 in the receiving surface 108 and is rotatable about a pivot axis A defined by at least one shaft mounted within the housing 102. The hole 112 may be sized and shaped such that the storage device connector 106 can rotate relatively freely about the pivot axis A within the hole 112. As illustrated in the top view of FIG. 4, the storage device connector 106 may include two shafts 118*a, b* extending to either side of the storage device connector 106, which define the pivot axis A. As illustrated in FIG. 3, the shafts 118*a, b* may be retained by and allowed to pivot within corresponding slots 120. In other embodiments, more or fewer shafts may define the pivot axis A of the storage device connector 106, and the at least one shaft may rotate within any of a variety of openings. In one embodiment, as illustrated, the pivot axis A of the storage device connector 106 is in substantial alignment with the axis W. Of course, in other embodiments, the pivot axis A of the storage device connector 106 need not be aligned with the axis W and may instead be in substantial alignment with the axis L, for example.

The rotation of the storage device connector 106 may enable a user to unload the storage device 110 from the storage device cradle 100 while exerting some torque on the storage device 110 without damaging the sensitive electrical connectors of the storage device 110 and the storage device cradle 100.

The storage device 110 may comprise any of a variety of external storage devices configured to communicate with a computer (not shown). For example, the storage device 110 may comprise an external disk drive having a USB, FireWire or other serial interface, a personal media device having an internal memory (e.g., an mp3 player), or a cellular phone having internal storage. In addition to the internal storage, the storage device 110 may include various controllers and/or processors configured to perform computing tasks.

The storage device 110 may include a cradle connector (illustrated in FIG. 7) configured to mate with the storage device connector 106. In one embodiment, as illustrated, the storage device connector 106 may comprise a male connector, and the storage device 110 may include a corresponding female cradle connector. Of course, in other embodiments, the storage device connector 106 may comprise a female connector, and the storage device 110 may include a corresponding male cradle connector.

Figure 4:
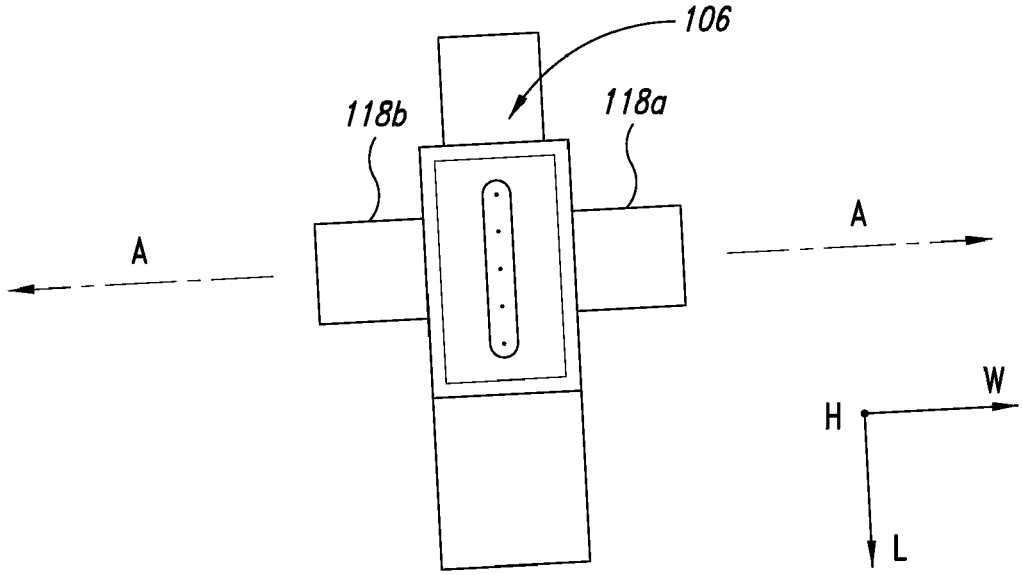
FIG. 4 is an enlarged, top view of a storage device connector of the storage device cradle of FIG. 1, according to one illustrated embodiment.
Figure 5:
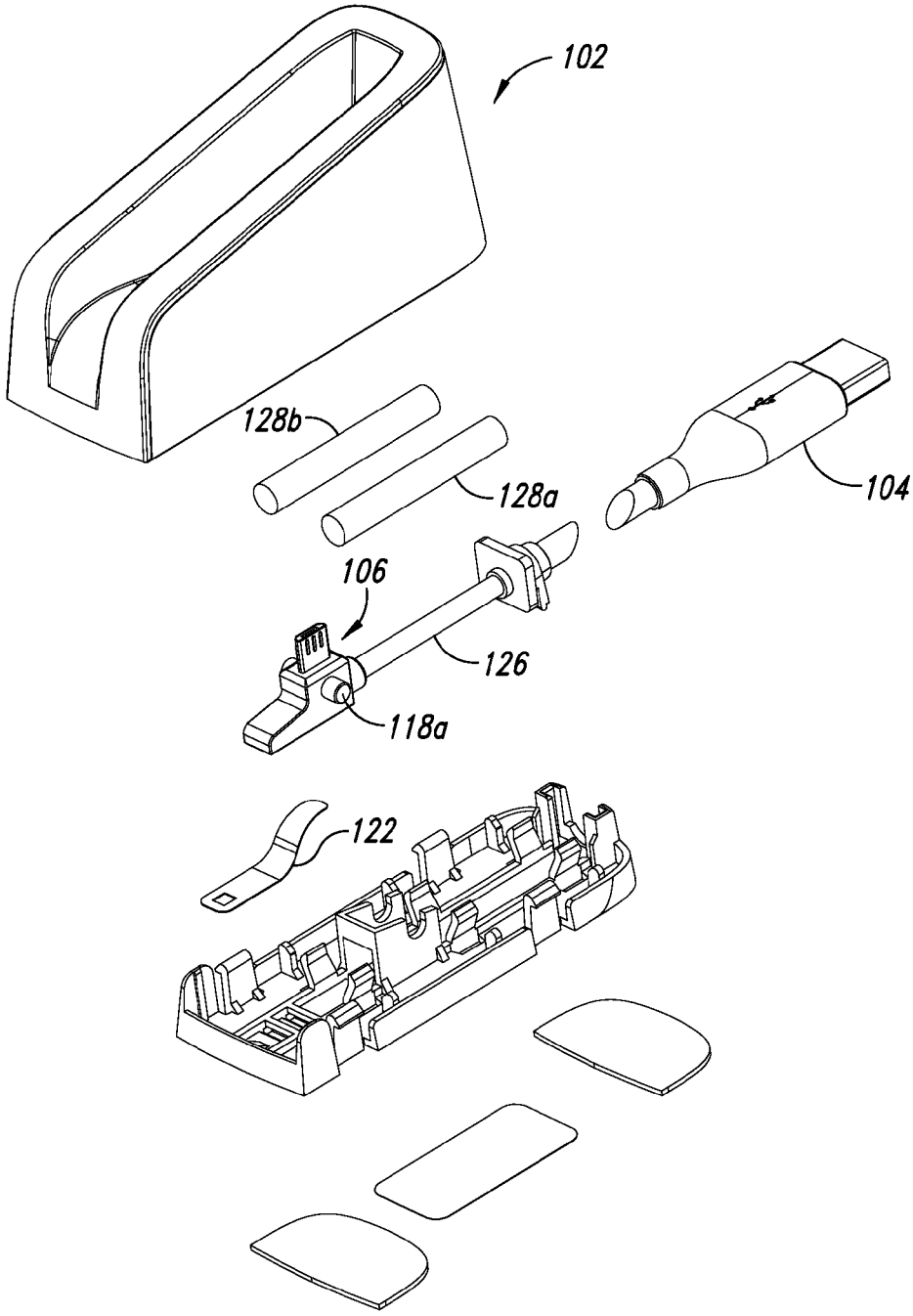
FIG. 5 is a perspective, exploded view of the storage device cradle of FIG. 1, according to one illustrated embodiment.
Figure 6A:
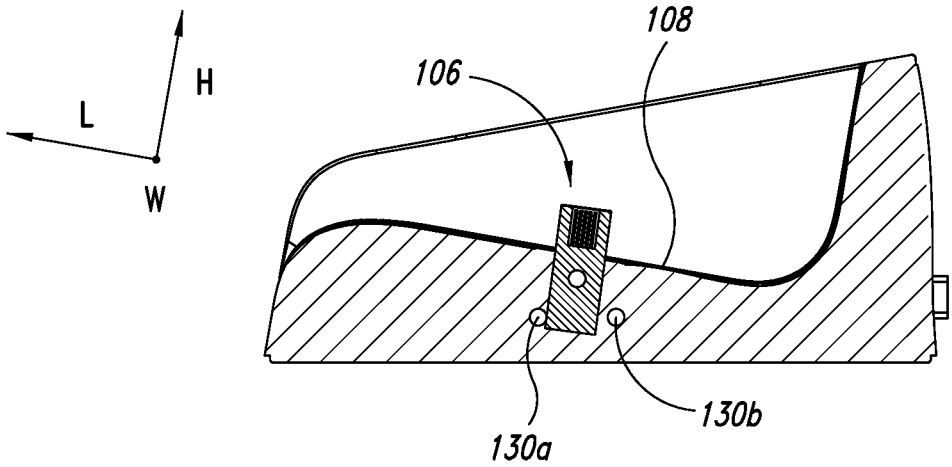
FIG. 6A is a side, schematic view of the storage device connector within the storage device cradle of FIG. 1 in a relaxed configuration against one stop, according to one illustrated embodiment.

FIGS. 3-5 illustrate the internal components of the storage device cradle 100 in greater detail. As best illustrated in FIG. 5, the storage device cradle 100 may include a spring 122 configured to bias the storage device connector 106 to a position wherein the storage device connector 106 extends substantially perpendicular to the receiving surface 108 (i.e., parallel with the axis H, as illustrated in FIG. 6A). The spring 122 may comprise any of a variety of spring elements and, in one embodiment, may comprise a leaf spring (as illustrated). Biasing the storage device connector 106 to this position may facilitate the loading of the storage device 110. In other embodiments, the storage device connector 106 may be biased to a position substantially perpendicular to a supporting surface, such as the ground or a table. In still other embodiments, the storage device connector 106 need not be biased in any particular direction.

In one embodiment, a cable 126 extends between the storage device connector 106 and the external interface 104. The cable 126 may have sufficient flexibility to enable the storage device connector 106 to pivot about the at least one shaft 118*a, b* substantially freely. Of course, in other embodiments, other electrical elements may be used to communicatively couple between the storage device connector 106 and the external interface 104.

FIGS. 3 and 5 also illustrate two masses 128*a, b* positioned within the housing 102. These masses 128*a, b* may be added to the storage device cradle 100 in order to increase the total mass of the storage device cradle 100 while maintaining the simplicity of its design. As described above, the increased mass may facilitate the unloading of the storage device 110 by acting as a counterweight to the forces generated as the connectors of the storage device 110 and the storage device cradle 100 are separated. Of course, in other embodiments, the storage device cradle 100 may include more or fewer components that are differently configured and arranged.

Figure 6B:
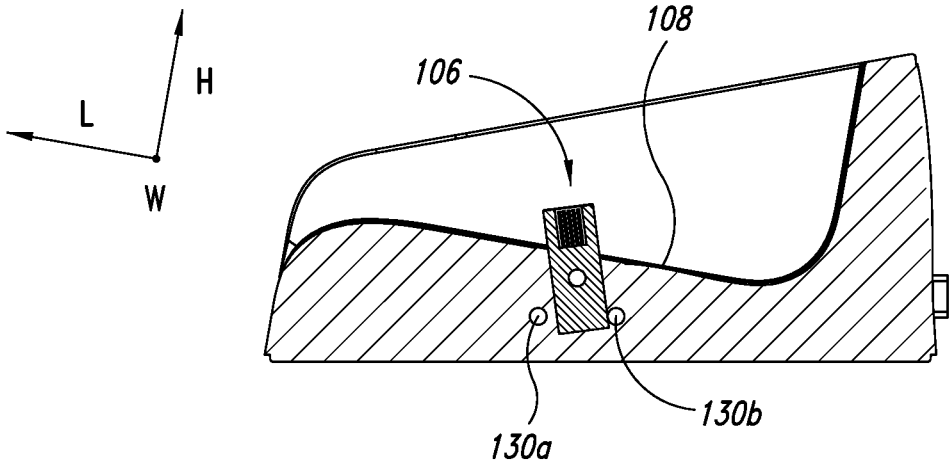
FIG. 6B is a side, schematic view of the storage device connector of FIG. 6A in a rotated configuration against another stop, according to one illustrated embodiment.
Figure 8:
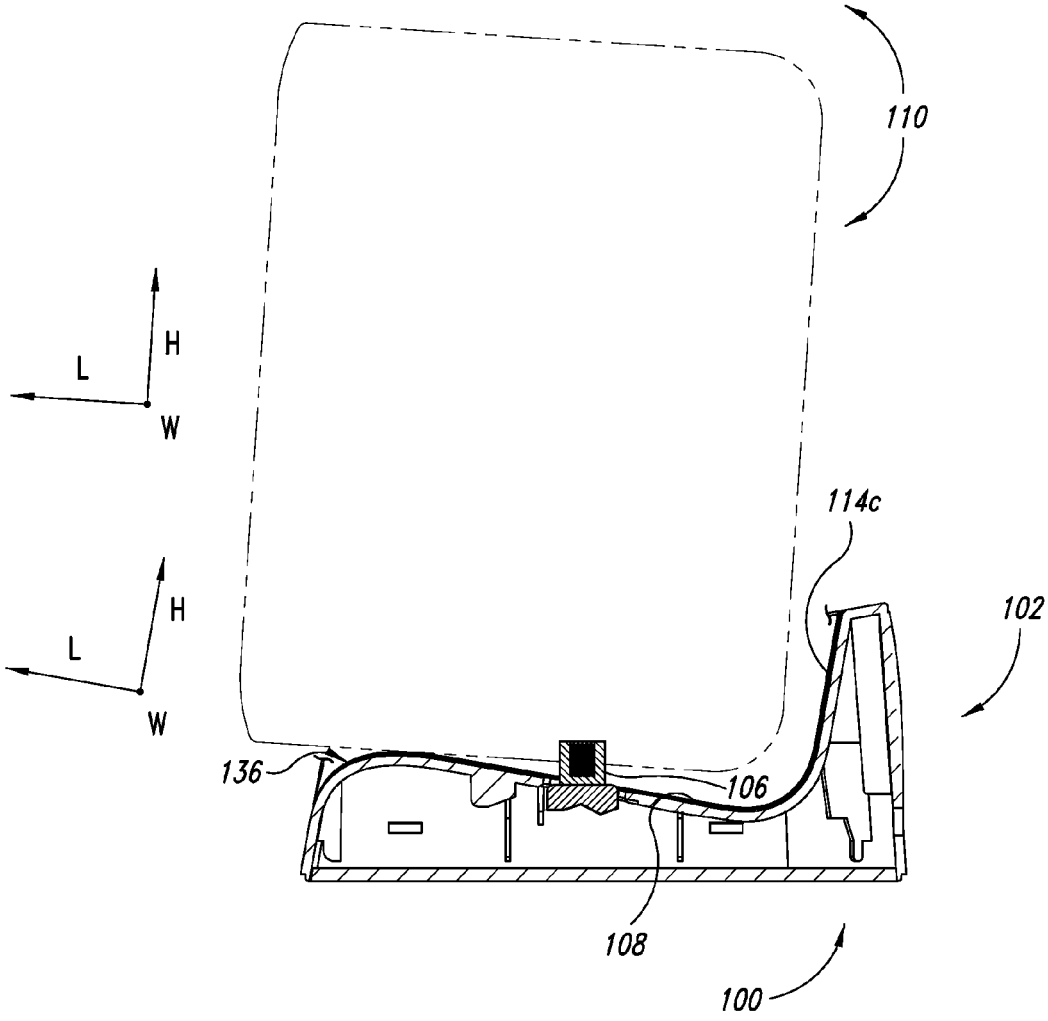
FIG. 8 is a side view of a storage device pivoting about the storage device cradle of FIG. 1 during an unloading operation, according to one illustrated embodiment.

FIGS. 6A and 6B schematically illustrate the storage device connector 106 against one of two stops 130*a, b* within the storage device cradle 100. In one embodiment, the housing 102 may include a stop 130*a, b* to each side of the storage device connector 106, the stops 130*a, b* configured to limit rotation of the storage device connector 106. In one embodiment, FIG. 6A illustrates the storage device connector 106 in a relaxed configuration biased against a first stop 130*a*. As illustrated, the storage device connector 106 may be pressed against the first stop 130*a* by the spring 122 (shown in FIG. 5) and may extend substantially perpendicularly to the receiving surface 108. With the storage device connector 106 in this relaxed configuration, the storage device 110 may be loaded by sliding a rear of the storage device 110 along the rear wall 114*c* until the storage device 110 is seated properly against the receiving surface 108. FIG. 6B illustrates the storage device connector 106 in a rotated configuration against a second stop 130*b*. In one embodiment, the storage device connector 106 may contact this second stop 130*b* as the storage device 110 is pivoted away from the storage device cradle 100 (as illustrated in FIG. 8). The stops 130*a, b* may thus circumscribe the rotation of the storage device connector 106 within the storage device cradle 100.

In one embodiment, the stops 130*a, b* may comprise distinct cylindrical obstructions within the housing 102, as illustrated. In other embodiments, the stops 130*a, b* may comprise differently shaped components within the housing 102, which, when combined with the geometry of the storage device connector 106, limit the connector's degree of rotation. For example, the two stops 130*a, b* may be formed by the bottom surface of the housing 102 of the storage device cradle 100, which may obstruct the complete rotation of the storage device connector 106. In one embodiment, the storage device connector 106 may rotate through approximately 30 degrees between the two stops 130*a, b*. In another embodiment, the storage device connector 106 may rotate through approximately 45 degrees between the two stops 130*a, b*. In other embodiments, the storage device connector 106 may rotate through a greater or lesser angle.

Figure 7:
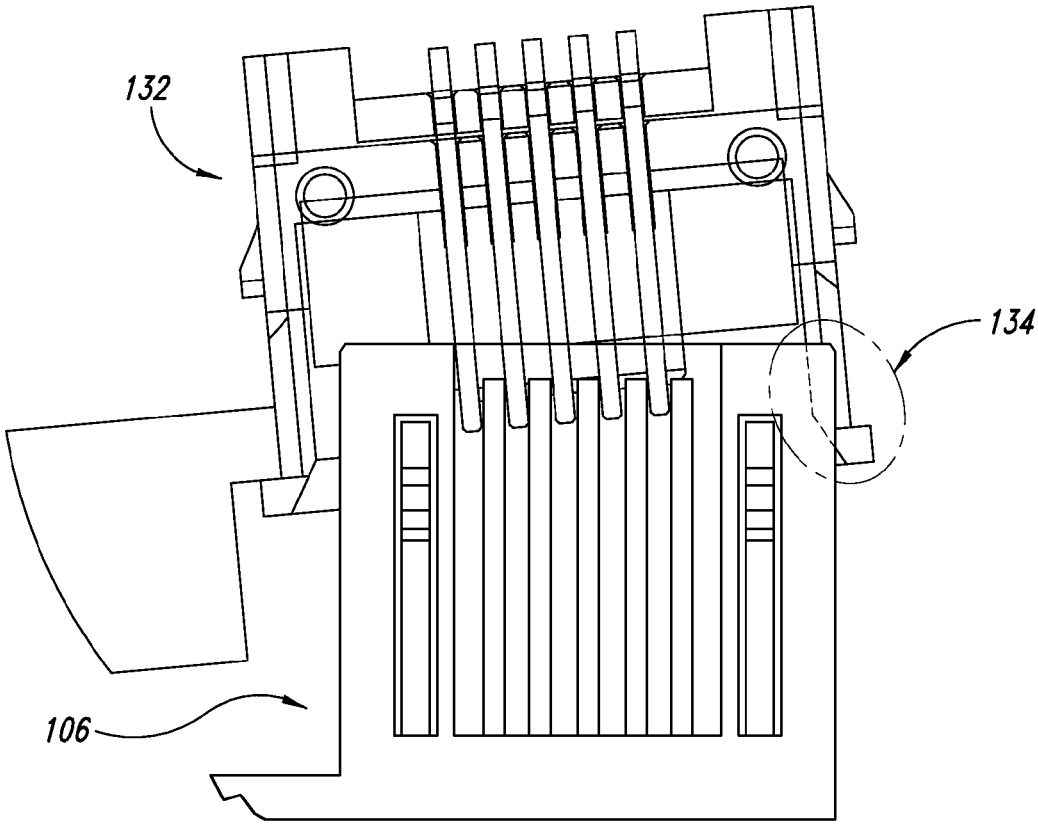
FIG. 7 is a magnified, schematic view of the storage device connector interacting with a cradle connector of a storage device, according to one illustrated embodiment.

FIG. 7 illustrates a magnified, schematic view of the storage device connector 106 and a cradle connector 132 of the storage device 110 during an unloading operation. As the angle between the storage device connector 106 and the cradle connector 132 grows too great, electrical shorts and/or mechanical breakage may occur. As highlighted by circle 134, certain surfaces of the two connectors 106, 132 have collided and are mechanically stressed at the illustrated angle. In one embodiment, these mechanical stresses may become too great at angles of greater than about six degrees. Therefore, it may be beneficial to design the storage device cradle 100 with the proper geometry to maintain the angle between the connectors 106, 132 below such a threshold when unloading the storage device 110. In one embodiment, the angle may be kept below six degrees. In another embodiment, the angle may be kept below three degrees.

As illustrated in FIG. 8, the storage device 110 may be unloaded from the storage device cradle 100 by pivoting the storage device 110 away from the storage device cradle 100. In one embodiment, the receiving surface 108 is adjacent a curved area 136 that is separated from the storage device connector 106 along the first axis L. The curved area 136 may be sized and configured such that the storage device 110 pivots about the curved area 136 (as illustrated by the arrow of FIG. 8) while unloading the storage device 110 from the storage device cradle 100. As the storage device 110 pivots about the curved area 136, the storage device connector 106 may also rotate about the pivot axis A, minimizing the angle formed between the storage device connector 106 and the cradle connector 132. By allowing this pivoting during the unloading operation, the total weight of the storage device cradle 100 may be kept relatively low, since the user may simultaneously push down on the storage device cradle 100 while unloading the storage device 110 from the cradle 100. Of course, the user may also simply pull the storage device 110 off of the storage device cradle 110 generally along the third axis H, perpendicularly to the receiving surface 108.

Figure 9:
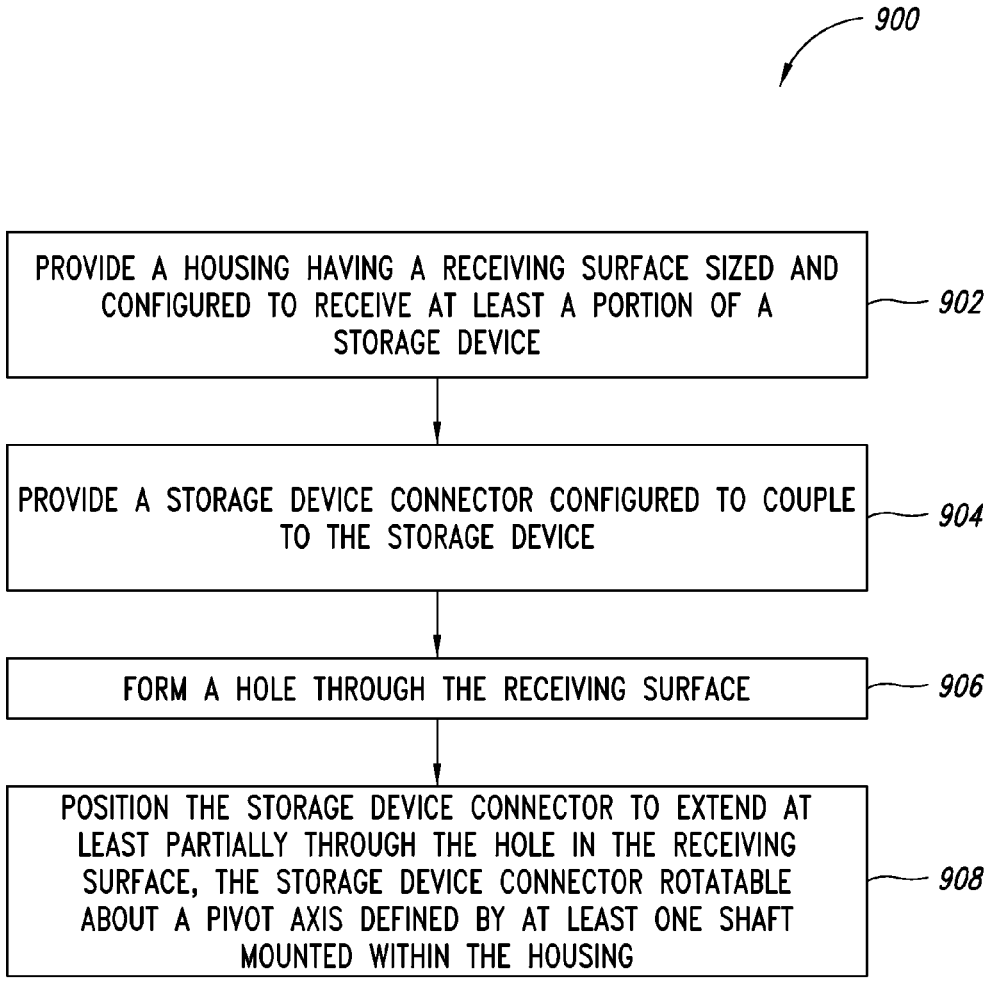
FIG. 9 illustrates a flow chart for a method of manufacturing a storage device cradle, according to one illustrated embodiment.

FIG. 9 illustrates a flow chart for a method 900 of manufacturing a storage device cradle, according to one illustrated embodiment. This method 900 will be discussed in the context of the storage device cradle 100 of FIGS. 1-8. However, the acts disclosed herein may be executed to produce a variety of different cradles, in accordance with the described method.

As described herein, at least some of the acts comprising the method 900 may be orchestrated by a processor according to an automatic manufacturing algorithm, based at least in part on computer-readable instructions stored in computer-readable memory and executable by the processor. A manual implementation of one or more acts of the method 900 may also be employed, in other embodiments.

At act 902, a housing 102 is provided, the housing 102 having a receiving surface 108 sized and configured to receive at least a portion of a storage device 110. In one embodiment, the housing 102 may be provided as a plurality of components that may be arranged and joined during a later stage. In another embodiment, the housing 102 may comprise a unitary piece provided in a form substantially similar to that shown in FIG. 1.

At act 904, a storage device connector 106 configured to couple to the storage device 110 is provided. As described above, the storage device connector 106 may comprise any of a variety of connectors configured to couple to the storage device 110. In one embodiment, the storage device connector 106 may comprise a USB connector configured to couple to the storage device 110.

A cable 126 may also be coupled between the storage device connector 106 and an external interface 104 configured to communicatively couple to a computer (not shown). The cable 126 may comprise any of a variety of wire configurations and may have sufficient flexibility to allow the storage device connector 106 to rotate relatively freely.

At act 906, a hole 112 is formed through the receiving surface 108. The hole 112 may be formed in a variety of ways. In one embodiment, the hole 112 may be formed by punching, sawing or otherwise creating a hole in the receiving surface 108. In other embodiments, the receiving surface 108 may be molded or pieced together in such a way that a hole 112 is formed therethrough.

At act 908, the storage device connector 106 is positioned to extend at least partially through the hole 112 in the receiving surface 108, the storage device connector 106 rotatable about a pivot axis A defined by at least one shaft 118*a, b* mounted within the housing 102. In one embodiment, the storage device connector 106 may be coupled to the at least one shaft 118*a, b* (e.g., the storage device connector 106 and the at least one shaft 118*a, b* may comprise a unitary component), and the storage device connector 106 and the at least one shaft 118*a, b* may together be mounted within the housing 102 such that the storage device connector 106 extends at least partially through the hole 112. In another embodiment, the at least one shaft 118*a, b* may first be mounted within the housing 102, and the storage device connector 106 may be coupled to the at least one shaft 118*a, b* in a position such that the storage device connector 106 extends at least partially through the hole 112.

The foregoing detailed description has set forth various embodiments of the devices and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, the embodiments disclosed herein, in whole or in part, can be equivalently implemented in standard integrated circuits, as one or more programs executed by one or more processors, as one or more programs executed by one or more controllers (e.g., microcontrollers), as firmware, or as virtually any combination thereof.

I claim:

1. A storage device cradle comprising:

a housing having a receiving surface sized and configured to receive at least a portion of a storage device, the receiving surface having a hole defined therethrough;

an external interface configured to communicatively couple to a computer; and a storage device connector extending at least partially through the hole in the receiving surface, the storage device connector communicatively coupled to the external interface and configured to couple to the storage device, the storage device connector rotatable relative to the receiving surface and about a pivot axis defined by at least one shaft mounted within the housing.

2. The storage device cradle of claim 1, further comprising a spring configured to bias the storage device connector to a position wherein the storage device connector extends substantially perpendicular to the receiving surface.

3. The storage device cradle of claim 1, wherein the housing includes a stop to each side of the storage device connector, the stops configured to limit rotation of the storage device connector.

4. The storage device cradle of claim 1, wherein the receiving surface defines a length along a first axis, and a width substantially shorter than the length along a second axis perpendicular to the first axis.

5. The storage device cradle of claim 4, wherein the pivot axis of the storage device connector is in substantial alignment with the second axis.

6. The storage device cradle of claim 4, wherein the receiving surface is adjacent a curved area separated from the storage device connector along the first axis, the curved area sized and configured such that the storage device pivots about the curved area while unloading the storage device from the storage device cradle.

7. The storage device cradle of claim 1, wherein the storage device connector is a universal serial bus connector.

8. The storage device cradle of claim 1, wherein the housing further includes a bottom surface configured to lie against a supporting surface, the receiving surface extending at an angle to the bottom surface.

9. The storage device cradle of claim 1, further comprising a cable extending between the storage device connector and the external interface.

10. A method of assembling a storage device cradle, comprising:

providing a housing having a receiving surface sized and configured to receive at least a portion of a storage device;

providing a storage device connector configured to couple to the storage device; forming a hole through the receiving surface; and positioning the storage device connector to extend at least partially through the hole in the receiving surface, the storage device connector rotatable relative to the receiving surface and about a pivot axis defined by at least one shaft mounted within the housing.

11. The method of claim 10, further comprising coupling a spring to the storage device connector to bias the storage device connector into a position wherein the storage device connector extends substantially perpendicular to the receiving surface.

12. The method of claim 10, further comprising forming a stop within the housing to each side of the storage device connector, the stops configured to limit rotation of the storage device connector.

13. The method of claim 10, wherein the receiving surface has a length along a first axis, and a width substantially shorter than the length along a second axis perpendicular to the first axis.

14. The method of claim 13, wherein the pivot axis of the storage device connector is in substantial alignment with the second axis.

15. The method of claim 13, wherein the receiving surface is adjacent a curved area separated from the storage device connector along the first axis, the curved area sized and configured such that the storage device pivots about the curved area while unloading the storage device from the storage device cradle.

16. The method of claim 10, wherein the storage device connector is a universal serial bus connector.

17. The method of claim 10, wherein the housing further includes a bottom surface configured to lie against a supporting surface, the receiving surface positioned at an angle to the bottom surface.

18. The method of claim 10, further comprising coupling a cable between the storage device connector and an external interface configured to communicatively couple to a computer.

19. A storage device cradle comprising:

a housing having a first stop and a second stop, and a receiving surface sized and configured to receive at least a portion of a storage device, the receiving surface having a hole defined therethrough;

an external interface configured to communicatively couple to a computer;

a shaft mounted within the housing and defining a pivot axis; and a storage device connector extending at least partially through the hole in the receiving surface, the storage device connector communicatively coupled to the external interface and configured to couple to the storage device, the storage device connector rotatable about the pivot axis, wherein the first stop and the second stop are configured to contact the storage device connector to limit rotation of the storage device connector about the pivot axis.

20. The storage device cradle of claim 19 wherein the first stop is configured to limit rotation of the storage device connector in a first direction about the pivot axis, and the second stop is configured to limit rotation of the storage device connector in a second direction opposite the first direction about the pivot axis.

* * * * *